United States Patent [19]

Jenkins, Jr.

[11] 3,955,244

[45] May 11, 1976

[54] FIBER RETRIEVER

[75] Inventor: R. B. Jenkins, Jr., Gastonia, N.C.

[73] Assignee: Jenkins Metal Shops, Inc., Gastonia, N.C.

[22] Filed: July 8, 1974

[21] Appl. No.: 486,515

[52] U.S. Cl. ..... 19/107

[51] Int. Cl.[2] ..... D01G 15/82

[58] Field of Search ..... 19/107, 105

[56] References Cited

UNITED STATES PATENTS

| | | | |
|---|---|---|---|
| 2,964,804 | 12/1960 | Schonenberger | 19/107 |
| 3,205,538 | 9/1965 | Miller et al. | 19/105 |
| 3,537,144 | 11/1970 | King, Jr. | 19/107 |

FOREIGN PATENTS OR APPLICATIONS

| | | | |
|---|---|---|---|
| 987,001 | 3/1965 | United Kingdom | 19/107 |
| 1,074,127 | 6/1967 | United Kingdom | 19/107 |
| 672,426 | 10/1964 | Italy | 19/107 |

*Primary Examiner*—Dorsey Newton
*Attorney, Agent, or Firm*—Clifton T. Hunt, Jr.

[57] ABSTRACT

A fiber retrieving apparatus is incorporated into the upper wall of an enclosure mounted beneath the lickerin. A suction outlet in the lower wall of the housing is connected to a source of suction for continuously removing trash, motes, fly, short fibers and the like collected therein. An air inlet is provided in either the front wall or rear wall or both to replace the air removed from the housing so that good fibers are not drawn from the lickerin roll.

4 Claims, 3 Drawing Figures

FIBER RETRIEVER

BACKGROUND OF THE INVENTION

In the operation of a carding machine, non-fibrous contaminants are normally removed from the cotton fibers by passing the fibers about a rotating lickerin cylinder which rotates in close proximity to mote knives, grid bars, or perforated plates. More recently, as illustrated in U.S. Pat. Nos. 3,205,538 to Miller, et al and 3,537,144 to King, Jr., it has been discovered that the trash can be separated from the fibers by exposing a transverse portion equal to approximately one-eighth of the total peripheral surface of the lickerin cylinder instead of using grid bars or mote knives; the forward and rear edges of the exposed area having downwardly extending partitions which extend across the width of the lickerin cylinder. Such an exposed area permits sufficient time for fibers and trash to react to aerodynamic and centrifugal forces thus accomplishing separation of the trash.

When utilizing an apparatus of the foregoing type, the trash and short fibers discharged from the lickerin cylinder are discharged onto the floor or into the area below the carding machine resulting in undesirable working conditions. Furthermore, the reusable fiber that is present in the discharged material becomes excessively contaminated, resulting in difficulty in processing the fiber for subsequent use.

Desirably, the trash and short fiber should be conveyed away from the area beneath the lickerin cylinder as it is there deposited to an area remote from the carding machine. Attempts to do so, however, as by merely connecting a vacuum conveyant system to prior art apparatus results in withdrawal of an excessive amount of fiber from the lickerin cylinder due to the resultant suction on the surface of the lickerin itself.

SUMMARY OF THE PRESENT INVENTION

With this in mind, the present invention is directed to an improved fiber retriever including a housing which substantially encloses the area beneath the lickerin, and, as the top wall thereof, a plurality of bars extending transversely across the lickerin, and an intermediate partition spaced from the rear wall of the housing which determines the exposed surface of the lickerin and effects the separation of trash from good fibers. A vacuum source is connected to the bottom wall of the housing to evacuate the trash, and to prevent robbing of good fibers from the lickerin surface, air inlets or openings are provided in at least one of the front and rear wall.

The primary object of the present invention is to provide an improved apparatus for removing trash and other contaminates from the area beneath the lickerin cylinder of a carding machine.

Another object of the present invention is to provide an improved fiber retriever useful in removing trash from the lickerin cylinder and conveying the trash to a location remote from the carding machine without removing excessive fiber from the lickerin cylinder as a result of the conveyance.

Other objects of the present invention, if not specifically set forth herein, will be obvious to one skilled in the art from a reading of the detailed description of the preferred embodiment of the invention, taken in conjunction with the drawings.

PREFERRED EMBODIMENT

Figure 1:
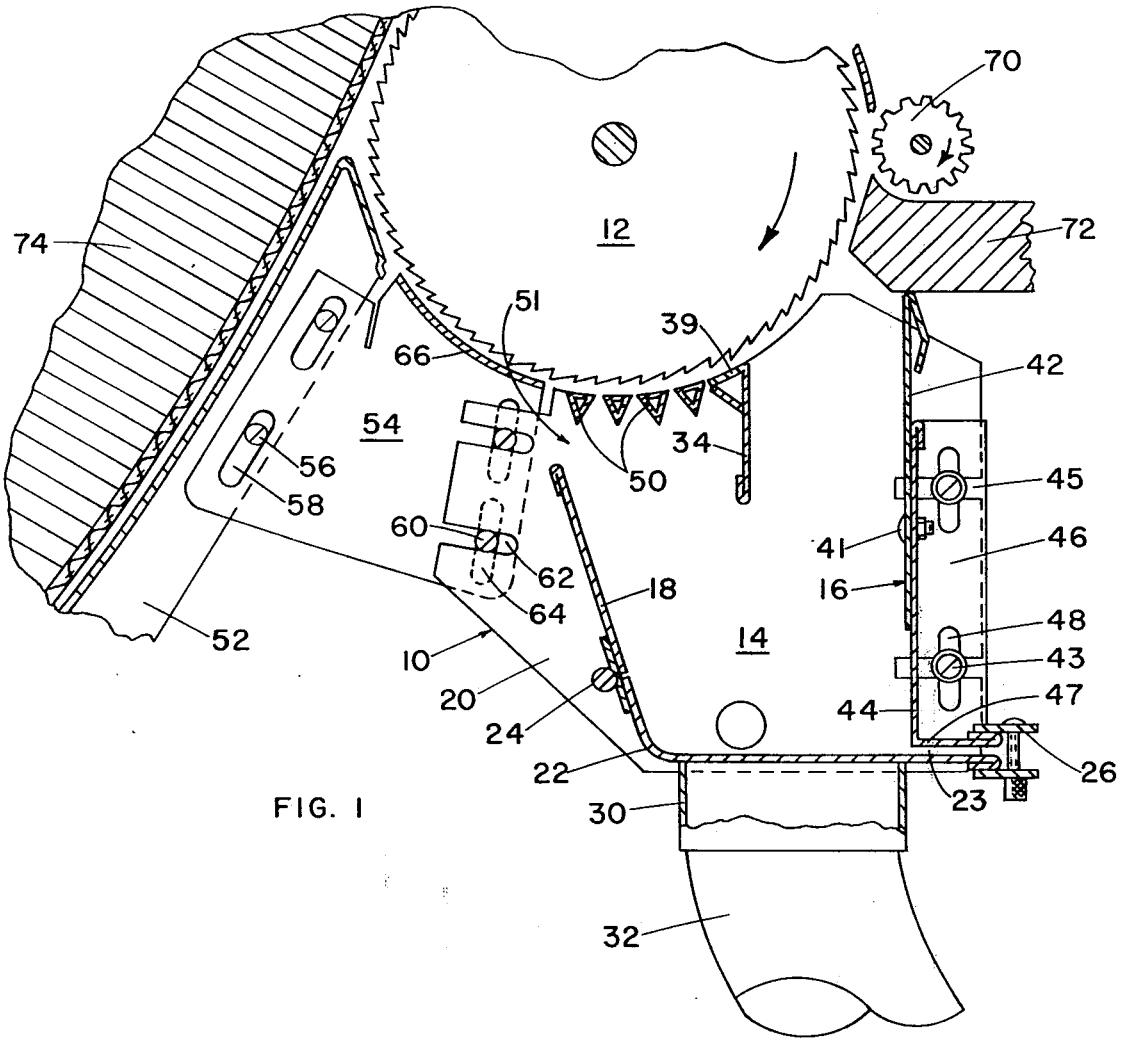
FIG. 1 is a side view of the fiber retriever of the present invention with one side plate removed in relation to the lickerin cylinder and main cylinder of a carding machine.
Figure 2:
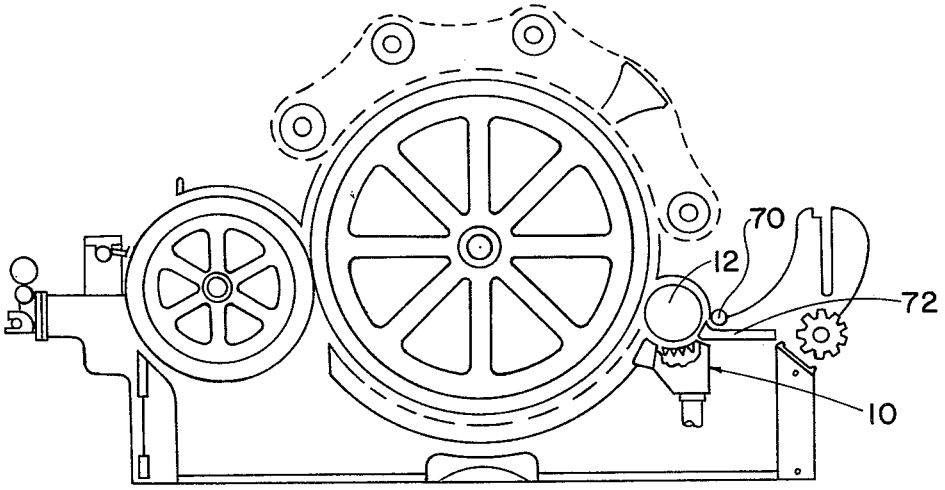
FIG. 2 is a side view of a conventional carding machine showing the location of the fiber retriever of the present invention.
Figure 3:
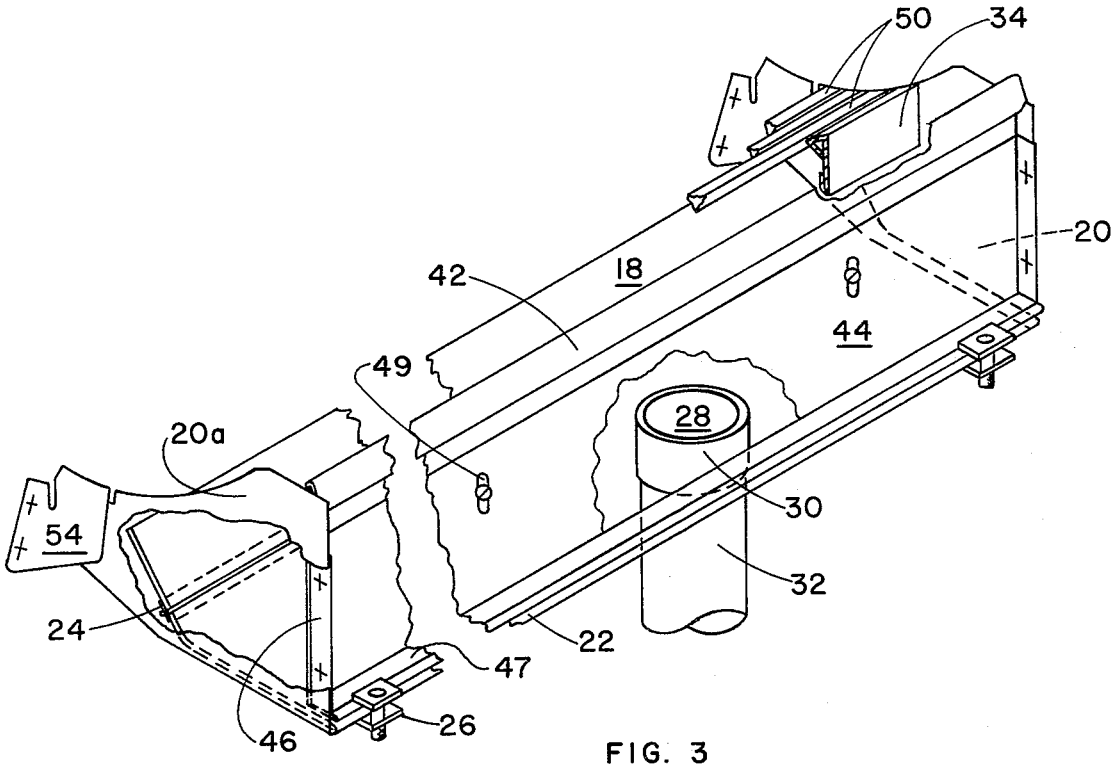
FIG. 3 is a perspective view of the fiber retriever with portions removed looking toward the rear of the fiber retriever.

In general, the present invention is directed to improvements in fiber retrievers, generally indicated at 10, whereby trash and short fibers are removed from the lickerin cylinder 12 of a carding machine and continuously conveyed away from the carding machine without the undesirable effect of pulling longer fibers from the surface of the lickerin cylinder.

More specifically, the fiber retriever of the present invention includes a collection chamber in the form of housing 14 mounted beneath the lickerin 12 and open at its upper end for communication therewith. Housing 14 is defined by a generally vertical rear wall 16 to be described hereinafter in greater detail, a front wall 18 preferably inclined rearwardly in its downward direction, a pair of end plates 20,20*a*, and a bottom wall 22. Front wall 18 may either be a solid or a perforated plate as hereinafter explained. Rear wall 16 and front wall 18 are attached at either end to the pair of spaced end plates 20,20a, and extend transversely across the width of the lickerin cylinder 12. The generally horizontal bottom wall 22 extends between end plates 20,20*a*, however is hingedly secured to front wall 18 by a continuous hinge member 24 rather than being attached to end plates 20,20*a*, and is releasably secured to rear wall 16 by means of an adjustable locking member 26 to provide access to the interior of the housing. An orifice 28 in bottom wall 22 is located equidistant from the opposite ends thereof and a cylindrical collar 30 extends downwardly from orifice 28 providing means for connecting a vacuum conduit 32 which communicates at its other end with a vacuum source, not shown.

Rear wall 16 includes an upper plate portion 42 and a lower plate portion 44, the latter provided with end flanges 46 which are adjustably attached to walls 20,20*a* by means of screw fasteners 43 extending through vertically elongated slots 48 in flanges 46 and through horizontally elongated slots 45 in end plates 20,20a. A bottom flange 47 extends rearwardly from the lower edge of lower plate portion 44 and as a result of the aforesaid adjustment may be set to define an adjustable opening 23 bottom wall 22.

A plurality of screw fasteners 41 extend through an opening in upper plate portion 42 and through corresponding vertically elongated slots 49 in lower plate portion 44, whereby the upper plate 42 is vertically adjustable with respect to lower plate portion 44 so that it can be adjusted snugly up against feed plate 72 regardless of the setting of lower plate 44.

A substantially vertical intermediate wall 34 extends from a point adjacent the lickerin 12 down into chamber 14 and across the width of lickerin cylinder 12. A relatively short upper curved portion 39 extends forwardly from the upper edge of wall 34 along an arcuate path generally parallel to the lickerin surface.

The upper portion of chamber 14 between walls 18 and 34 includes a plurality of parallel screen bars 50 extending between end plates 20,20a and positioned relative to each other along an arcuate path spaced from and generally parallel to lickerin cylinder 12. The upper end of front wall 18 is spaced from bars 50 to provide an opening 51 between the forwardmost bar 50 and wall 18.

An arcuate front plate 66 is positioned adjacent lickerin 12 and adjustably attached to the main cylinder screen frame 52 by means of screw fasteners 56 which extend through opening 58 in frame 52 and slotted openings in end plates 54, the end plates depending from opposite ends of plate 66. Fiber retriever 10 is adjustably secured to the rear portion of end plates 54 by means of screw fasteners 60 which extend through horizontally elongated slots 62 in end plates 20,20*a* of fiber retriever 10 and through vertically elongated slots 64 in mounting bracket 54, respectively.

In operation, a lap of fibers is directed between feed roll 70 and feed plate 72 into contact with the lickerin cylinder 12. As the lap is moved downwardly by lickerin cylinder 12, the rotation of the lickerin past the opening between rear wall 16 and intermediate wall 34 causes trash on the surface of the lap to be directed into chamber 14, the removal of trash being aided by the rearmost edge of curved upper portion 39. The space between intermediate wall 34 and rear wall 16 may be adjusted to obtain the proper setting for optimum trash removal. As the lap moves further along, it is brought into contact with bars 50 which act to remove additional trash which passes between the bars and also into chamber 14. The lap is then further carried by the lickerin cylinder into contact with main cylinder 14 for further processing.

Simultaneously with the removal of trash from the lap by the fiber retriever, a negative pressure is generated within chamber 14 by a vacuum source acting through conduit 32. This vacuum removes trash and short fibers falling into chamber 14 and carries them to a remote location where the reusable fibers may be separated from the trash if desired. Without at least one of the openings 51,23 the suction would tend to rob the lickerin roll of good fibers, because a greater than normal suction would be applied to the surface of lickerin 12. Openings 51,23 however are adjustable, as hereinbefore described, so that essentially all of the air which enters chamber 14 to replace the air drawn off by suction enters through openings 51,23 when properly adjusted and no extraneous suction is applied to lickerin 12. This is the basic concept of the present invention. By utilizing an apparatus of this nature, it has been found that the trash and fibers may be successfully withdrawn from chamber 14 without the undesirable effect of pulling additional fibers from lickerin cylinder 12. One alternative is the possibility of using a perforated plate (not shown) as front wall 18 rather than spacing the front wall from bars 50 to provide opening 51.

It will be obvious to the skilled artisan from a reading of the foregoing description that many modifications and variations may be made without departing from the spirit and scope of the invention.

What is claimed is:

1. In a carding machine having a feed roll and a lickerin roll equipped with a fiber retriever of the type comprising a pair of spaced planar partitions extending downwardly from the lickerin roll and a series of screen bars extending across the width of the lickerin roll forwardly of the planar partitions, the improvement comprising a vacuum source, a housing for enclosing the area beneath said bars and partitions wherein said bars and the upper edges of said partitions form the upper wall of said housing and one of said partitions forms the rear wall of said housing, said housing further including a front wall, a pair of end plates, a bottom wall, said bottom wall having an opening therein providing communication between the inside of said housing and said vacuum source, said rear wall including an opening through which air is drawn to replace the air drawn off by said vacuum source without disturbing the action of the fiber retriever, said bottom wall being hingedly attached at the front end thereof to the bottom edge of said front wall, and a removable retaining means holding said rear wall and the rear end of said bottom wall in a normally closed position, whereby when said retaining means is removed, said bottom wall swings away from said rear wall for access to the interior of said enclosure.

2. A structure according to claim 1 wherein the upper edge of said front wall is spaced below said bars to form another opening for incoming air.

3. A structure according to claim 1 wherein said rear wall includes a plate slidable vertically with respect to said bottom wall, and said opening is formed between said bottom wall and the lower edge of said rear wall.

4. A structure according to claim 3 wherein said rear wall comprises an upper plate and a lower plate, means mounting said lower plate for vertical adjustment relative to said end plates and means mounting said upper plates for adjustment in a vertical direction relative to said lower plate, whereby when said opening between the bottom wall and the lower edge of said rear wall is set, said upper plate may be subsequently properly positioned with respect to the carding machine.

* * * * *